United States Patent [19]

Goetzberger

[11] Patent Number: 4,763,310

[45] Date of Patent: Aug. 9, 1988

[54] ELECTRONIC CLOCK WITH SOLAR CELL AND RECHANGEABLE BATTERY

[75] Inventor: Adolf Goetzberger, Merzhausen, Fed. Rep. of Germany

[73] Assignee: Fraunhofer-Gesellschaft zur Forderung, Freiburg, Fed. Rep. of Germany

[21] Appl. No.: 399

[22] Filed: Jan. 5, 1987

[30] Foreign Application Priority Data

Jan. 10, 1986 [DE] Fed. Rep. of Germany ..... 3600515

[51] Int. Cl.[4] ..... G04G 1/00; G04C 3/00

[52] U.S. Cl. ..... 368/205

[58] Field of Search ..... 368/205, 66

[56] References Cited

U.S. PATENT DOCUMENTS 4,015,420 4/1977 Walker ..... 368/66

4,296,489 10/1981 Mitsui ..... 368/205

FOREIGN PATENT DOCUMENTS 3115682 4/1982 Fed. Rep. of Germany ..... 368/66

2158274 11/1986 United Kingdom ..... 368/205

*Primary Examiner*—Bernard Roskoski

*Attorney, Agent, or Firm*—Willian Brinks Olds Hofer Gibson & Lione

[57] ABSTRACT

A solar powered electronic clock has a display, time-keeping electronics, a battery, and a solar cell array. The battery is chargeable from the solar cell array and supplies only the time-keeping electronics while the display is powered only by the solar cell array. A diode connected between the solar cell array and battery permits the battery to be recharged, but prevents the display from drawing energy from the battery.

9 Claims, 1 Drawing Sheet

ELECTRONIC CLOCK WITH SOLAR CELL AND RECHANGEABLE BATTERY

FIELD OF THE INVENTION

The invention relates to solar powered electronic clocks in general, and in particular to solar powered electronic clocks with a back-up power source.

BACKGROUND OF THE INVENTION

Electronic clocks with quartz-crystal oscillators are part of the state of art. Ordinarily, such clocks are powered by primary batteries. In the last few years, the power consumption of electronic time-keeping and display circuitry has decreased and it has become possible to power these clocks with electricity provided by solar cells. Wrist watches containing rechargeable batteries and solar cells for recharging are also known.

Electronic clocks with low-voltage high capacity capacitors have also been introduced on the market. The capacitors of such clocks are charged with solar cells positioned in the dial, and achieve a running-time power reserve of 50 hours. However, that power reserve appears insufficient for the winter season in the Federal Republic of Germany and in countries of similar geographic locations.

The purpose of the invention is to create a solar powered electronic clock with a high running-time power reserve to ensure proper time-keeping over periods of prolonged darkness.

SUMMARY OF THE INVENTION

The purpose of the invention is achieved by separating the display device from the rechargeable energy source and connecting the display directly to the solar cell array for immediate power supply.

The display device typically has the larger energy need, particularly those displays used in larger clocks. Unlike the prior art, the display of the invention receives its power directly from the solar cell array and not from the energy storage device and is generally operational only when the ambient lighting is also sufficient to enable a person to read the display. The separation of the display from the energy source results in substantial energy savings, and thus an increased power reserve.

The time-keeping circuitry, on the other hand, is powered at all times by an energy storage device, either in the form of a battery or capacitor, preserving the time-keeping function during periods of time in which the display is inactive due to inadequate light. A liquid crystal display is preferable because of its reduced energy consumption; however, a mechanical hand unit driven by a stepping motor may also be utilized. In either embodiment, the display will, upon sufficient illumination of the solor cell array, be reset to display the time represented by an output from the time-keeping circuitry.

A non-rechargeable battery may also be used instead of a rechargeable energy source, in which case the solar cell array operates exclusively to power the display device and not charge the battery.

DETAILED DESCRIPTION OF THE PRESENTLY PREFERRED EMBODIMENTS

Figure 1:
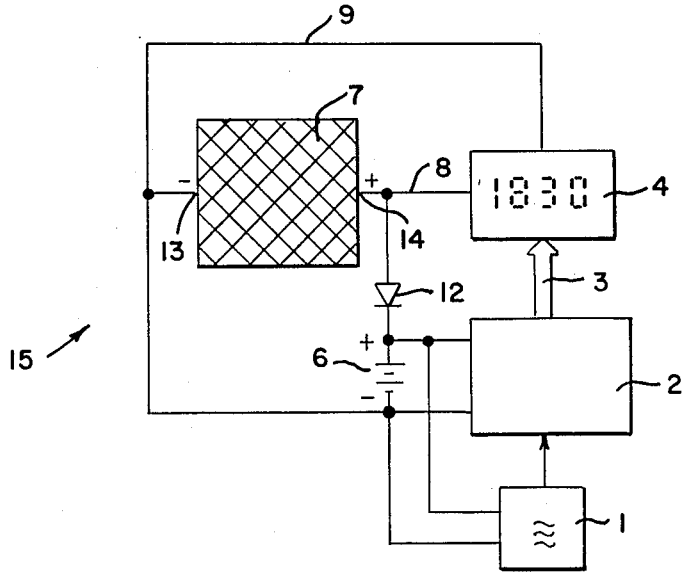
FIG. 1 is an electrical block diagram of a first embodiment of the invention with a liquid crystal display.

The electronic clock 15 illustrated in FIG. 1 has a quartz-crystal oscillator 1, which serves as frequency reference for a clock circuit 2 that performs the time-keeping function of the electronic clock.

Clock circuit 2 includes actuating switches (not shown) which allow clock circuit 2 to be set to a specified time, date, weekday, wake-up time or other parameters. To simplify the drawing, other components that may be present, like those for the stop-watch function as well as acoustical announcers of the time and/or alarm-clock times, are not illustrated. Those skilled in the art will recognize that the clock circuit 2 may be equipped with such additional switch circuits or functions.

Figure 2:
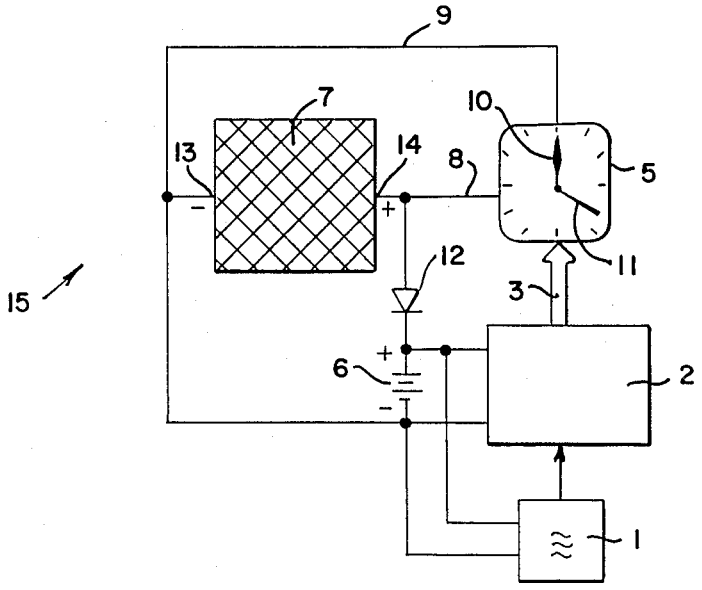
FIG. 2 is an electrical block diagram another embodiment of the invention with a mechanical clock hand unit.

An output of the clock circuit 2 representative of the time of day is connected via data bus 3 with a display device, which in the embodiment of FIG. 1 is a liquid crystal display 4, and in the embodiment of FIG. 2 is a mechanical hand unit 5 with hand elements 10 and 11. The hand unit 5 illustrated in FIG. 2 is provided with a stepping motor and associated control electronics (not shown) in a manner known to the art.

As shown in FIGS. 1 and 2, quartz-crystal oscillator 1 and clock circuit 2 are supplied with electrical energy by an electrical storage device, preferably a rechargeable battery 6 or a low-voltage capacitor with high capacity (not shown). A non-rechargeable battery (not shown) may also be used.

A solar cell array 7, illustrated in FIGS. 1 and 2, is connected via conductors 8 and 9 with the liquid crystal display 4 of FIG. 1 and the mechanical hand unit 5 of FIG. 2, to supply the liquid crystal display 4 and hand unit 5 with electrical energy. Thus, the liquid crystal display 4 and the hand unit 5 are driven directly via the solar cell array 7 without intermediate connection of the electrical storage device 6.

As illustrated in FIG. 1, a diode 12 provides the electrical separation of rechargeable battery 6 from liquid crystal display 4. The anode of diode 12 is connected to solar cell array 7 and display 4 by conductor 8 and its cathode is connected to the positive pole of battery 6.

In this configuration, electrons from the negative pole 13 of solar cell array 7 can get to the negative pole of battery 6, and from the positive pole of battery 6 via diode 12 to the positive pole 14 of solar cell array 7. If the voltage existing between negative pole 13 and positive pole 14 of solar cell array 7 exceeds the voltage of battery 6 by more than the threshold voltage of diode 12, recharging or additional charging of battery 6 results.

However, if the voltage between the negative and positive poles of solar cell array 7 is less than the battery voltage, diode 12 is reverse biased and prevents the discharging of battery 6 for the operation of liquid crystal display 4. Diode 12 thus ensures that battery 6, as recharged by solar cell array 7, only supplies power to the electronics, i.e., quartz-crystal oscillator 1 and clock circuit 2 and that liquid crystal display 4 is operated directly from the solar cell array 7.

Liquid crystal display 4 is only in operation when there is also enough lighting for the reading of the display. When the solar array 7 is exposed to enough light to generate sufficient energy to power the display 4, the display indicates the time of day represented by the output of clock circuit 2.

Clock circuit 2, on the other hand, is always powered by the battery or the capacitor thereby guaranteeing the preservation of the time function of clock circuit 2. Since the battery no longer provides power to the display, the energy saved is used to power the clock electronics for a longer period of time, thus resulting in a substantial increase in the battery power reserve.

The clock illustrated in FIG. 2 operates in the same manner. When a mechanical hand unit 5 is utilized with a stepping motor, it becomes necessary to correctly position hand elements 10, 11 which have been at a standstill when the display is inactive to the proper time defined by clock circuit 2 via data bus 3. This is done in the schematically diagramed embodiment of FIG. 2 by the control electronics of the stepping motor, which with the occurrence of sufficiently high voltage at conduits 8 and 9 guides the stepping motor and the hand elements 10 and 11 until their position corresponds with the time provided through data bus 3.

An alternative embodiment of the invention (not shown) utilizes a non-rechargeable battery instead of a rechargeable electrical storage device such as the battery of FIGS. 1 and 2. In this embodiment, the solar cell array 7 only powers the display device, i.e., liquid crystal display 4 or mechanical hand unit 5, and does not charge the non-rechargeable battery. In this particular embodiment there is no need for an electrical connection between conductor 8 and the non-rechargeable battery, so diode 12 may be eliminated.

I claim:

1. An electronic clock comprising:

means for storing electrical energy;

means connected to said storage means and powered thereby for counting the passage of time, said counting means having an output representative of the time of day;

means for converting light into electrical energy; and means responsive to said output of said counting means for displaying the time of day, said means deriving operating power only from said light converting means.

2. The electronic clock of claim 1 wherein said energy storage means is rechargeable, further comprising means connected between said light converting means and said energy storage means for allowing the conduction of electrical energy from said light converting means to said energy storage means and blocking the conduction of electrical energy from said energy storage means to said means for displaying time.

3. The electronic clock of claim 2 wherein said means for allowing the conduction of electrical energy from said light converting means to said energy storage means and blocking the conduction of electrical energy from said energy storage means to said means for displaying time comprises a diode.

4. The electronic clock of claim 2 wherein said means for storing electrical energy comprises a battery.

5. The electronic clock of claim 2 wherein said means for storing electrical energy comprises a capacitor.

6. The electronic clock of claim 2 wherein said means for displaying the time of day comprises a liquid crystal display.

7. The electronic clock of claim 2 wherein said means for displaying the time of day comprises a mechanical hand unit control unit and stepping motor.

8. An electronic clock comprising:

a rechargeable battery;

time-keeping circuitry connected to said rechargeable battery and powered thereby, said circuitry having an output representative of the time of day;

a solar cell for generating electrical energy;

a display connected to said solar cell and said time-keeping circuitry and responsive to said output representative of the time of day; and a diode connected between said solar cell and said rechargeable battery so that said diode allows electrical energy generated by said solar cell to be conducted to said rechargeable battery, and prevents electrical energy from flowing from said battery to said display.

9. An electrical clock comprising:

a rechargeable capacitor;

time-keeping circuitry connected to said rechargeable capacitor and powered thereby, said circuitry having an output representative of the time of day;

a solar cell for generating electrical energy;

a display connected to said solar cell and said time-keeping circuitry and responsive to said output representative of the time of day; and a diode connected between said solar cell and said rechargeable capacitor so that said diode allows electrical energy generated by said solar cell to be conducted to said rechargeable capacitor, and prevents electrical energy from flowing from said capacitor to said display.

* * * * *